US011839894B2

(12) United States Patent
Gillest et al.

(10) Patent No.: US 11,839,894 B2
(45) Date of Patent: Dec. 12, 2023

(54) SPRAY GUN ADJUSTMENT SYSTEM

(71) Applicants: Kevin Gillest, Frasier, CO (US); Michael Calahan, Arvada, CO (US); Kalvis Jaunarajs, Littleton, CO (US); Christopher Goldsmith, Broomfield, CO (US); Logan Ostrander, Golden, CO (US)

(72) Inventors: Kevin Gillest, Frasier, CO (US); Michael Calahan, Arvada, CO (US); Kalvis Jaunarajs, Littleton, CO (US); Christopher Goldsmith, Broomfield, CO (US); Logan Ostrander, Golden, CO (US)

( * ) Notice: Subject to any disclaimer, the term of this patent is extended or adjusted under 35 U.S.C. 154(b) by 0 days.

(21) Appl. No.: 17/590,809

(22) Filed: Feb. 1, 2022

(65) Prior Publication Data

US 2022/0152643 A1 May 19, 2022

Related U.S. Application Data

(63) Continuation-in-part of application No. 16/696,990, filed on Nov. 26, 2019, which is a continuation-in-part of application No. 15/858,292, filed on Dec. 29, 2017, now Pat. No. 10,518,285, which is a continuation-in-part of application No. 14/484,229, filed on Sep. 11, 2014, now Pat. No. 9,889,460.

(51) Int. Cl.

| | |
|---|---|
| ***B05B 13/06*** | (2006.01) |
| ***B05B 15/52*** | (2018.01) |
| ***B05B 15/68*** | (2018.01) |
| ***B05B 13/02*** | (2006.01) |

(52) U.S. Cl.
CPC ..... *B05B 13/069* (2013.01); *B05B 13/0278* (2013.01); *B05B 13/0609* (2013.01); *B05B 15/52* (2018.02); *B05B 15/68* (2018.02)

(58) Field of Classification Search
USPC ..... 118/319, 318, 306, 317, 321, 323, 118/313–315
See application file for complete search history.

(56) References Cited

U.S. PATENT DOCUMENTS

| | | | | |
|---|---|---|---|---|
| 1,185,889 A | | 6/1916 | Eberhart | |
| 4,379,731 A | * | 4/1983 | Long | B05B 13/0405 156/557 |
| 4,606,942 A | * | 8/1986 | Shriver | B05B 13/0609 427/236 |

* cited by examiner

*Primary Examiner* — Yewebdar T Tadesse
(74) *Attorney, Agent, or Firm* — Craig W. Barber; BARBER LEGAL

(57) ABSTRACT

An improved device for adjusting spray guns in an IC spray machine. Adjustments may be done using electro-mechanical or pneumatic actuators, and may rotate the nozzles toward an evacuation hood for cleaning, etc. Two actuators are used per spray gun, one mechanically engaged to a slide which moves the gun in translation (traversing in the X dimension), one which is mechanically engaged to a bracket which in turn is mechanically engaged to the gun mount, so the gun may be either moved or rotated. In addition, a Z-axis beam allows control in depth by an additional actuator/motor.

14 Claims, 13 Drawing Sheets

SPRAY GUN ADJUSTMENT SYSTEM

STATEMENT REGARDING FEDERALLY FUNDED RESEARCH

This invention was not made under contract with an agency of the US Government, nor by any agency of the US Government.

FIELD OF THE INVENTION

This invention relates generally to can spraying/coating machinery having spray guns mounted to coat the interior of a cylindrical body such as a beverage and/or food can, but more specifically to adjustment of the position and angle of the spray guns and their mounts.

BACKGROUND OF THE INVENTION

In the can making process, regardless of the material of the cans, there is a normal requirement that the interior of the can be coated with an internal coating to increase product longevity/shelf life, decrease degradation of the can material (such as pin holes or leaking product and protect the product in the package and for other reasons depending on circumstances. In general, the liquid or solid content of the can and the metal of the can must be protected from one another or the shelf life of the product in the can (beverage, cosmetic, food, etc.) might be greatly affected.

The traditional internal coating spray machine (IC machine) has a spray gun which is pressurized from rear end feeds to shoot a relatively even spray out of a nozzle end and into the open end of a can or other cylindrical container. Some IC machines have multiple spray guns. Cans are fed into the IC spray machine star wheel, a rotating wheel with pockets on the circumference. Each can fits into one pocket. The star wheel advances, for example, in an indexed motion in which the star wheel pockets advance by one pocket location/rotation and then pauses, or in other cases, moving without indexed motion.

When the pocket containing an unsprayed can reaches a position with the open end of the can directly across from the nozzle of the spray gun or guns, the gun or guns is/are activated to spray the coating material in a fine, somewhat even, spray, thus coating some portion, often all, of the interior of the can. In one possible arrangement, the IC machine may have two guns which spray into two different cans in two different pocket locations. Another option with two gun arrangements is a first gun may spray either the cut edge (around the open end of the can interior) or else the lower, deeper portions of the can interior, all the way down to the bottom of the can and the dome, if any. Obviously the second spray gun then sprays the other, unsprayed portion, when the can indexes around to be located under the second spray gun nozzle, spraying at different times.

There is usually an overlap between the two patterns. After spraying is completed the can is discharged onto a conveyor belt for further processing by other equipment.

Another issue is that in modern systems a recovery hood sucks the overspray (excess, airborne) spray droplets out of the machine, entrained in the ambient atmosphere from the machine housing, for recovery or safe disposal such as incineration.

Finally, the nozzle ends of the guns have another problem: the nozzle tends to build-up coating material which clings around the nozzle, with the excess coating clinging to material already clinging, so that a stalactite style buildup occurs, creating what is informally known in the industry as a "pig tail". In addition, the machine during periods of non-use suffers from nozzles becoming clogged with coating which sets up, in a manner similar to a consumer spray paint can nozzle getting jammed when unused or not cleaned.

Known prior art spray guns are adjusted in several common general operations: 1) adjusting for nozzle erosion as a production run continues, 2) adjusting for different can sizes between production runs, and 3) adjusting after replacement of spray gun sets or changes in coating viscosity.

These adjustments happen in three dimensions: two dimensions of translation and one dimension of rotation. (In general, the third dimension of translation, referred to here as the "Y" dimension, is fixed by the size of the star wheel installed on the IC machine and does not require adjustment). By adjusting in the two dimensions of transverse motion—depth and horizontal location—and the dimension of rotation, the angle at which the nozzle sprays into the can interior, the entire process could be controlled to minimize overspray and maximize coverage per unit of coating.

However, there are adjustment issues. This process is carried out by skilled and very experienced operators using hand tools to adjust the spray gun locations and angles. Inexperienced operators struggle with some phases of this frequent adjustment requirement.

It would be preferable to provide an easy mechanical/electrical method of adjusting the spray guns without resorting to manual operations.

It would further be preferable to allow preset adjustments to be implemented as required, so that inexperienced operators could simply apply known adjustments: for example, if a first can size run is ending and a second can size run is being set up, an operator could simply set known parameters in three dimensions into the IC machine spray gun control and see the spray guns being physically adjusted without recourse to operator judgement.

It would also be preferable to allow the machine to clean itself free of build-ups such as pig tails, to allow the machine to keep its own nozzles clean during periods of non-use, with periodic sprays of coating or air, cleaning fluid, or other projectile matter.

SUMMARY OF THE INVENTION

General Summary

As used herein, the term "actuator motor" refers to any one of the following: a servo motor, a stepper motor, an actuator, a linear actuator, a pneumatic valve and control, or other devices, other devices than a motor, etc.

The present invention teaches a better device for adjusting spray guns in an IC spray machine. Instead of operator hand adjustments which rely upon the experience level of the operator, adjustments may be done using electro-mechanical or pneumatic actuators/motors such as servos, steppers, pneumatic valves, actuators, and so forth. By sending signals to these devices to energize them in a first mode, the spray guns may be automatically placed in a first location and angle, but in a second mode, the spray guns may be automatically moved to a second location and angle. This change can be done because a different size or shape of can is being sprayed, or because nozzles are eroding, or because new guns are being installed, material changes with the coating, and so forth.

In addition, the controller of the new mechanical adjustment system may be instructed to rotate the nozzles toward an evacuation hood for cleaning, or to spray the nozzles (dry or wet with coating) at intervals during periods of disuse, and so forth.

The system teaches a set of two actuators per spray gun, one mechanically engaged to a slide which moves the gun in translation (traversing in the X dimension), one which is mechanically engaged to a bracket which in turn is mechanically engaged to the gun mount so the gun may be rotated. One pair may be used per gun. In addition, the set of actuators, slides, brackets, guns, mounts, etc. may sit on a rider on a Z-axis beam and be controlled in depth (the Z-dimension) by an additional actuator/motor.

Summary in Reference to Claims

It is therefore another aspect, advantage, objective and embodiment of the invention, in addition to those discussed previously, to provide an internal coating spray machine comprising:

an exhaust hood;

a star wheel having a plurality of pockets;

a first spray gun having a nozzle, the first spray gun and first spray gun nozzle oriented so as to spray into a first one of the plurality of pockets;

a first spray gun mount, the first spray gun mounted thereon, a first rotation guide, the first spray gun mounted riding on the first rotation guide, whereby the first spray gun mount and the first spray gun may both rotate in a single dimension designated R;

a first X-axis slide, the first X-axis slide having the first rotation guide;

a first X-axis guide, the first X-axis slide mechanically engaged to the first X-axis slide;

a first X-axis actuator motor mount, the first X-axis guide mounted to the first X-axis actuator motor mount, whereby the first X-axis slide, the first rotation guide, the first spray gun mount, and the first spray gun may all traverse in a single dimension designated X;

a first X-axis actuator motor mounted on the first X-axis actuator motor mount, the first X-axis actuator motor mechanically engaged to the first X-axis slide so that the traverse in the dimension X is both caused and controlled by the first X-axis actuator motor;

a first X-axis rotation bracket mechanically engaged to the first spray gun mount;

a first X-axis rotation motor mounted on the X-axis actuator motor mount, the first X-axis actuator motor mechanically engaged to the first X-axis rotation bracket, whereby the rotation in the dimension R is both caused and controlled by the first X-axis rotation actuator motor;

whereby when the first X-axis actuator motor and the first X-axis rotation actuator motor are energized in a first mode, the first spray gun will assume a first position and angle relative to the first one of the plurality of pockets, but when the first X-axis actuator motor and the first X-axis rotation actuator motor are energized in a second mode, the first spray gun will assume a second position and angle relative to the first one of the plurality of pockets.

It is therefore another aspect, advantage, objective and embodiment of the invention, in addition to those discussed previously, to provide an internal coating spray machine further comprising:

the first rotation guide having a partial circular shape having a focus, the focus located at the first spray gun nozzle, whereby rotation in the dimension R occurs about the first spray gun nozzle.

It is therefore another aspect, advantage, objective and embodiment of the invention, in addition to those discussed previously, to provide an internal coating spray machine further comprising:

the first X-axis motor mount riding on a Z-axis beam whereby the first X-axis motor mount, first X-axis slide, the first rotation guide, the first spray gun mount, and the first spray gun, as well as the first X-axis rotation actuator motor and the first X-axis rotation bracket may all traverse in a single dimension designated Z orthogonal to the dimension designated X;

a Z-axis actuator motor mechanically engaged to the first X-axis motor mount whereby the traverse in the dimension Z is both caused and controlled by the Z-axis rotation actuator motor.

It is therefore another aspect, advantage, objective and embodiment of the invention, in addition to those discussed previously, to provide an internal coating spray machine wherein at least member of the group consisting of: the first X-axis actuator motor, the first X-axis rotation actuator motor, and the Z-axis actuator motor comprises: an actuator.

It is therefore another aspect, advantage, objective and embodiment of the invention, in addition to those discussed previously, to provide an internal coating spray machine wherein at least member of the group consisting of: the first X-axis actuator motor, the first X-axis rotation actuator motor, and the Z-axis actuator motor comprises: a servo motor.

It is therefore another aspect, advantage, objective and embodiment of the invention, in addition to those discussed previously, to provide an internal coating spray machine wherein at least member of the group consisting of: the first X-axis actuator motor, the first X-axis rotation actuator motor, and the Z-axis actuator motor comprises: a stepper motor.

It is therefore another aspect, advantage, objective and embodiment of the invention, in addition to those discussed previously, to provide an internal coating spray machine wherein at least member of the group consisting of: the first X-axis actuator motor, the first X-axis rotation actuator motor, and the Z-axis actuator motor comprises: a pneumatic actuator.

It is therefore another aspect, advantage, objective and embodiment of the invention, in addition to those discussed previously, to provide an internal coating spray machine wherein the star wheel is oriented in a vertical plane of rotation.

It is therefore another aspect, advantage, objective and embodiment of the invention, in addition to those discussed previously, to provide an internal coating spray machine wherein the star wheel is oriented in a horizontal plane of rotation.

It is therefore another aspect, advantage, objective and embodiment of the invention, in addition to those discussed previously, to provide an internal coating spray machine wherein the rotation guide allows the rotation in the dimension R to point the first spray gun nozzle in a third position and angle pointing away from the first pocket and toward the exhaust hood, whereby when the first X-axis actuator motor and the first X-axis rotation actuator motor and the Z-axis actuator motor are energized in a third mode, the first spray gun will assume the third position and angle.

It is therefore another aspect, advantage, objective and embodiment of the invention, in addition to those discussed previously, to provide an internal coating spray machine further comprising: a controller operative to energize the actuator motors in the first, second and third modes as desired or according to a schedule.

It is therefore another aspect, advantage, objective and embodiment of the invention, in addition to those discussed previously, to provide an internal coating spray machine further comprising:

a second spray gun having a nozzle, the second spray gun and second spray gun nozzle oriented so as to spray into a second one of the plurality of pockets;

a second spray gun mount, the second spray gun mounted thereon, a second rotation guide, the second spray gun mounted riding on the second rotation guide, whereby the second spray gun mount and the second spray gun may both rotate in the single dimension designated R;

a second X-axis slide, the second X-axis slide having the second rotation guide;

a second X-axis guide, the second X-axis slide mechanically engaged to the second X-axis slide;

a second X-axis actuator motor mount, the second X-axis guide mounted to the second X-axis actuator motor mount, whereby the second X-axis slide, the second rotation guide, the second spray gun mount, and the second spray gun may all traverse in the single dimension designated X;

a second X-axis actuator motor mounted on the second X-axis actuator motor mount, the second X-axis actuator motor mechanically engaged to the second X-axis slide so that the traverse in the dimension X is both caused and controlled by the second X-axis actuator motor;

a second X-axis rotation bracket mechanically engaged to the second spray gun mount;

a second X-axis rotation motor mounted on the second X-axis actuator motor mount, the second X-axis actuator motor mechanically engaged to the second X-axis rotation bracket, whereby the rotation in the dimension R is both caused and controlled by the second X-axis rotation actuator motor;

whereby when the second X-axis actuator motor and the second X-axis rotation actuator motor are energized in the first mode, the second spray gun will assume a third position and angle relative to the second one of the plurality of pockets, but when the second X-axis actuator motor and the second X-axis rotation actuator motor are energized in the second mode, the second spray gun will assume a fourth position and angle relative to the second one of the plurality of pockets.

It is therefore another aspect, advantage, objective and embodiment of the invention, in addition to those discussed previously, to provide an internal coating spray machine further comprising:

a second spray gun having a nozzle, the second spray gun and second spray gun nozzle oriented so as to spray into the first one of the plurality of pockets and into such can disposed in the first pocket;

a second spray gun mount, the second spray gun mounted thereon, a second rotation guide, the second spray gun mounted riding on the second rotation guide, whereby the second spray gun mount and the second spray gun may both rotate in the single dimension designated R;

a second X-axis slide, the second X-axis slide having the second rotation guide;

a second X-axis guide, the second X-axis slide mechanically engaged to the second X-axis slide;

a second X-axis actuator motor mount, the second X-axis guide mounted to the second X-axis actuator motor mount, whereby the second X-axis slide, the second rotation guide, the second spray gun mount, and the second spray gun may all traverse in the single dimension designated X;

a second X-axis actuator motor mounted on the second X-axis actuator motor mount, the second X-axis actuator motor mechanically engaged to the second X-axis slide so that the traverse in the dimension X is both caused and controlled by the second X-axis actuator motor;

a second X-axis rotation bracket mechanically engaged to the second spray gun mount;

a second X-axis rotation motor mounted on the second X-axis actuator motor mount, the second X-axis actuator motor mechanically engaged to the second X-axis rotation bracket, whereby the rotation in the dimension R is both caused and controlled by the second X-axis rotation actuator motor;

whereby when the second X-axis actuator motor and the second X-axis rotation actuator motor are energized in the first mode, the second spray gun will assume a third position and angle relative to the first one of the plurality of pockets, but when the second X-axis actuator motor and the second X-axis rotation actuator motor are energized in the second mode, the second spray gun will assume a fourth position and angle relative to the first one of the plurality of pockets.

INDEX TO REFERENCE NUMERALS

Figure 1:
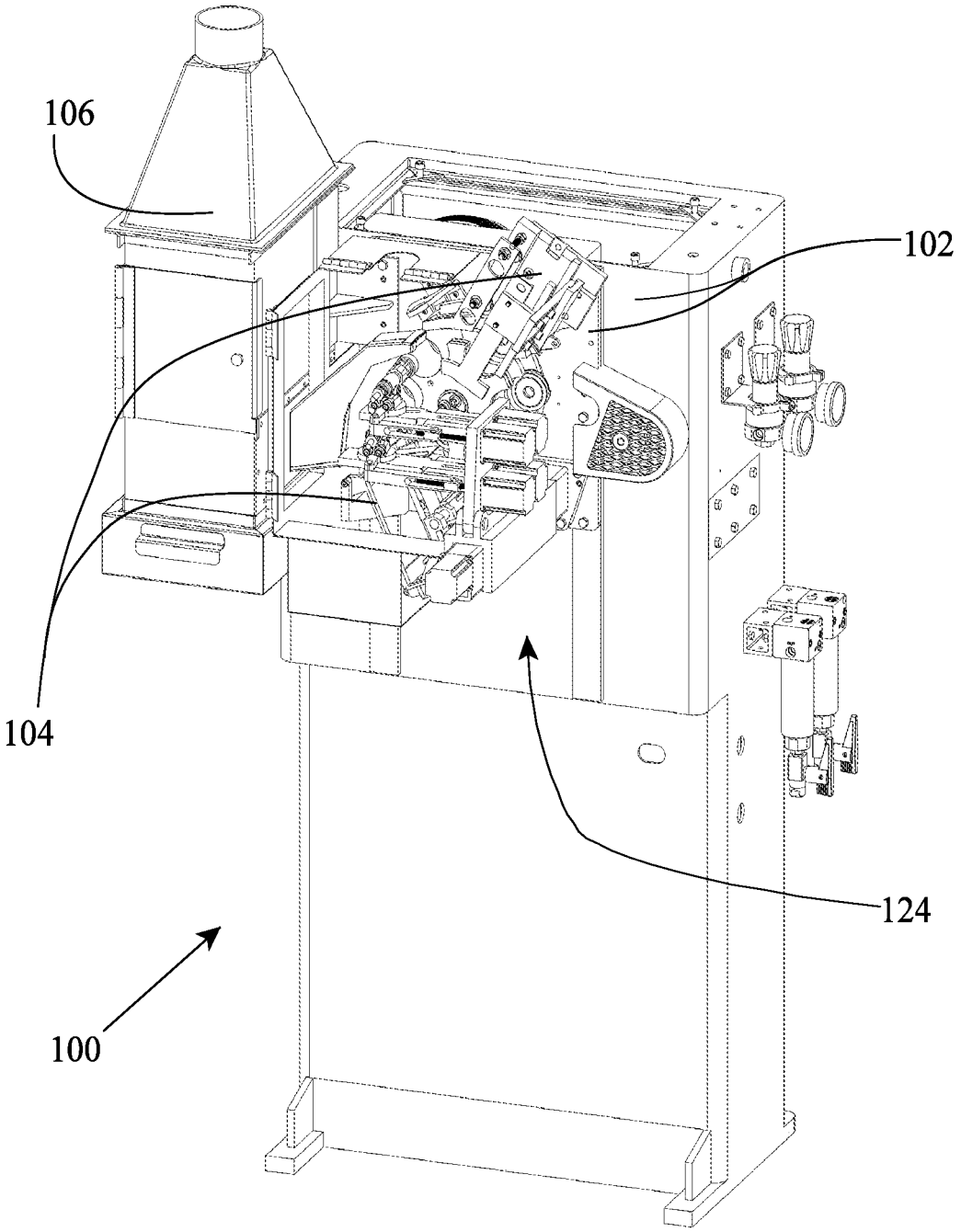
FIG. 1 is an overview elevational oblique diagram of a first embodiment of the invention showing the overall coating machine.

IC spray machine 100
Housing 102
Container feed mechanism 104
Particulate coating capture hood 106
Sensors (limit switches) 108
Star wheel 110
Pocket 112, 114
Can 116, 118
First spray gun 120
First spray gun, different position 120'
Second spray gun 122
First spray gun mount assembly/Z-axis slide 124
First spray gun mount 125
First spray gun X-axis actuator motor 126
First spray gun X-axis rotation motor 128
First spray gun nozzle tip 130
X-axis 131
X-axis slide 132
X-axis guide 133
X-axis rotation bracket 134
X-axis rotation bracket, different position 134'
X-axis actuator motor mount 135
First spray gun rear end 136
First spray gun inlets (see FIG. 7) 137
X-axis rotation guide slot 138
Z-axis (FIG. 8) 139
Z-axis beam 140
Z-axis actuator motor 142
Z-axis mount to housing 102 144
Pigtail 150
Control panel 152
Controller 154
Nozzle cleaning blade 156

DETAILED DESCRIPTION

Glossary

As used herein, the term "actuator motor" refers to any one of the following: a servo motor, a stepper motor, an actuator, a linear actuator, a pneumatic valve and control, or other devices, other devices than a motor, etc.

Three dimensions are defined and herein, an "X" dimension which traverses sideways across the face of a star wheel, a "Z" dimension which indicates the distance from a spray gun nozzle to a can/can interior/the star wheel the can sits in, and finally a dimension of rotation "R", indicating the angle of the spray gun relative to the can interior. Another dimension, "Y", is not used (traversing across the face of the star wheel perpendicular to the X dimension) as this dimension is set by the size of the star wheel installed on the spray machine.

Three positions may also be defined by this coordinate system. In a first position or mode, a gun may spray a first portion of a first size and shape of can, but in a second position or mode, a gun may spray a different portion of a second size and shape of can. A third mode allows the gun to swivel away from the pocket holding cans and instead point into a collection hood, or scrape its own nozzle across a cleaning edge/blade, so as to remove a pig tail.

These modes are exemplary only, not limiting.

Finally any body or void having a semi-circular shape must by the laws of geometry have a "focus", since a circle is one of the conical sections. In the present invention, a semi-circular slot is used to control a body mechanically engaged with the slot as it rotates, thus forcing the rotation to occur about the focus of the semi-circular slot. In the present invention, the focus of the semi-circular slot is the nozzle of a spray gun.

End Glossary

Figure 2:
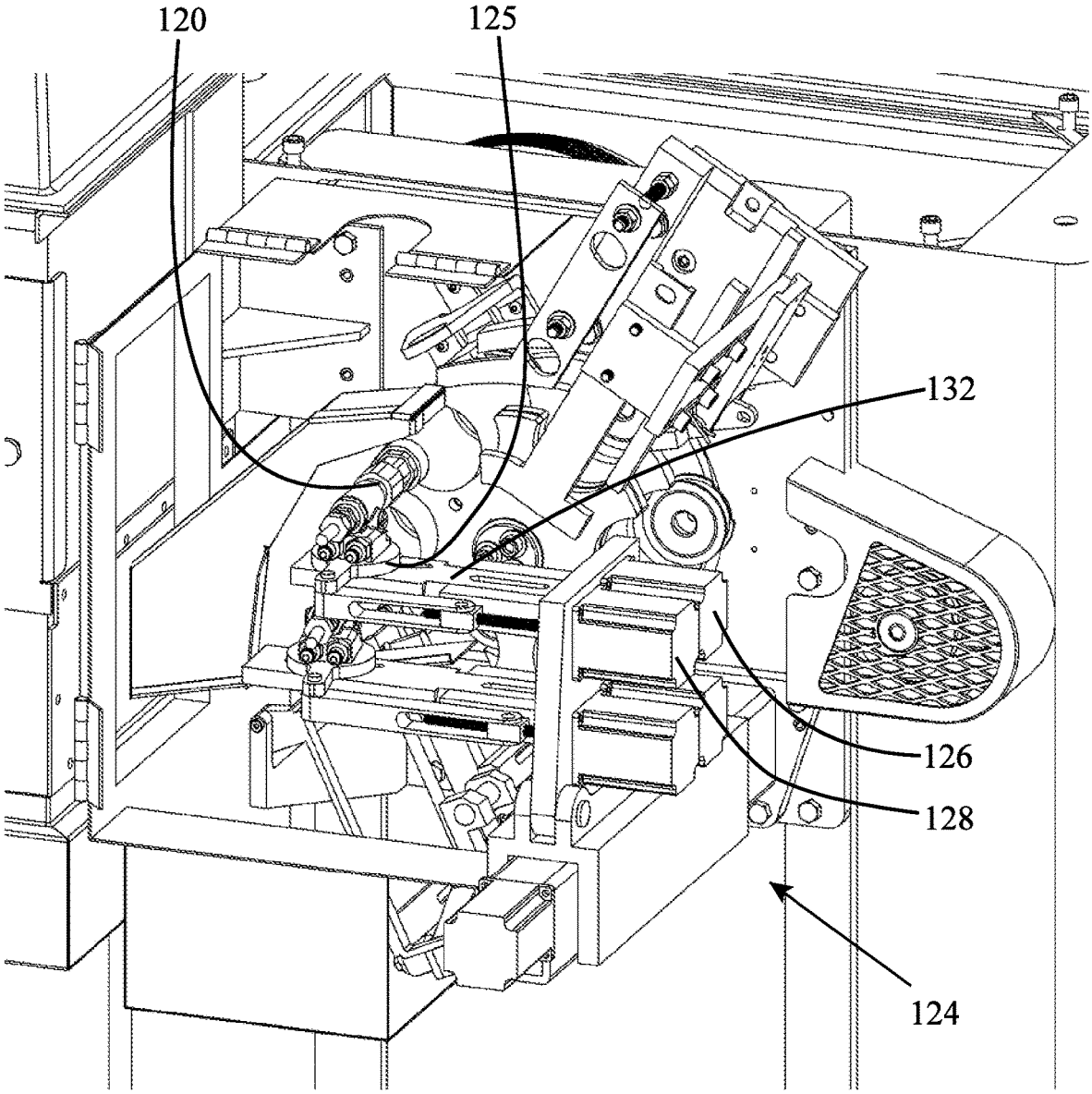
FIG. 2 is a close up elevational oblique view of the first embodiment of the invention showing the star wheel area, the spray guns, their mounts and the mechanical adjustment mechanisms for the guns.

FIG. 1 is an overview elevational oblique diagram of a first embodiment of the invention showing the overall coating machine 100. The IC spray machine 100 (partially shown) has a housing and/or frame 102, can feed mechanisms 104 (only partially shown), a particulate capture hood 106 and other equipment. FIG. 2 is a close up elevational oblique view of the first embodiment of the invention showing the star wheel area, the spray guns, their mounts and the mechanical adjustment mechanisms for the guns. The hood 106 is seen to be located on one side of the spray guns, where it can remove by suction air laden with overspray/coating, for disposal or incineration.

Figure 3:
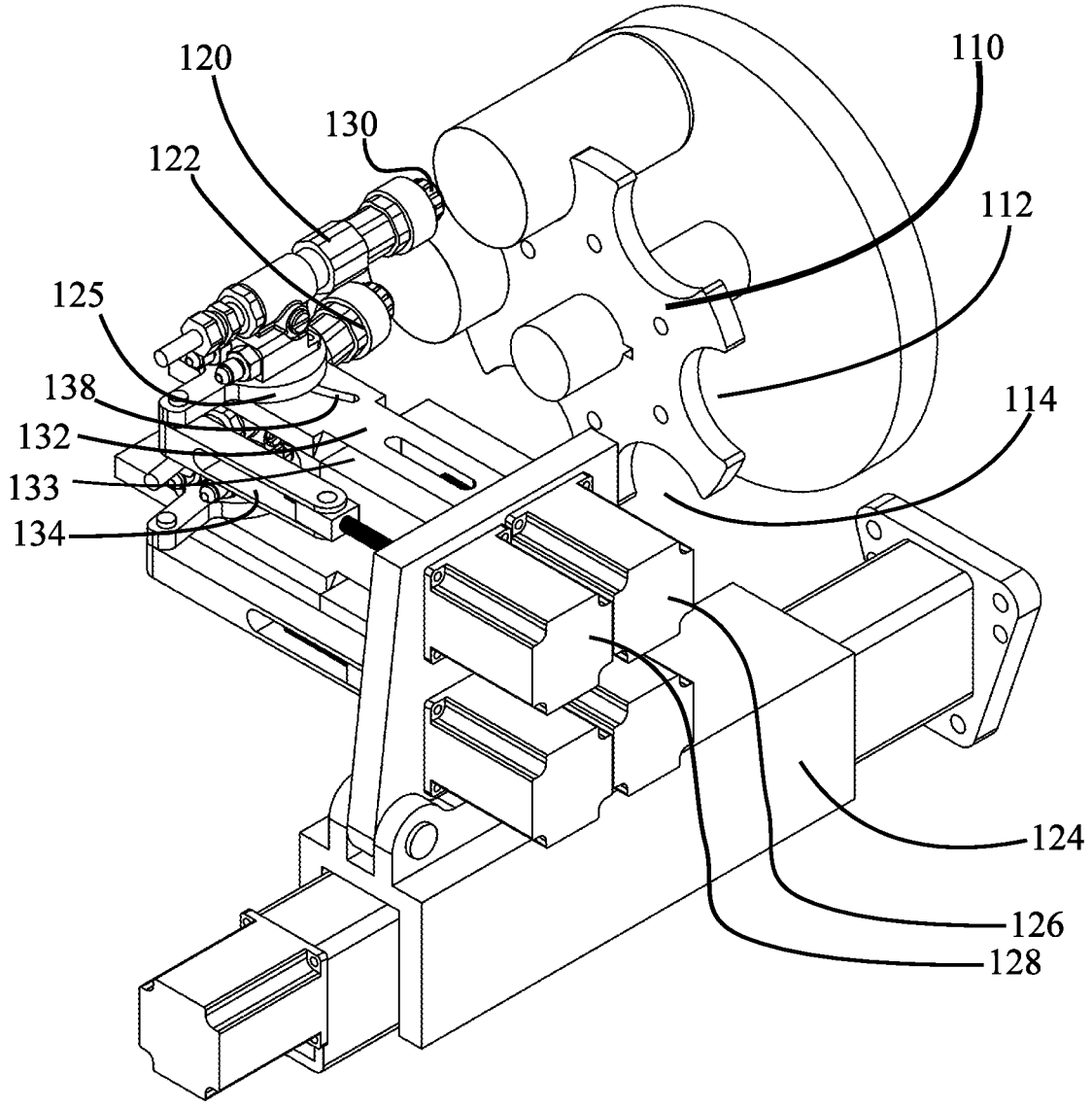
FIG. 3 is an elevational oblique left rear view of the first embodiment of the gun mount of the invention showing the guns, mounts and mechanical and/or electrical adjustment mechanisms, in particular the adjustment motors. The star wheel and two cans are shown for clarity as well.

Star wheel 110 is visible but still difficult to see behind other machinery but will be apparent in FIG. 3 et seq. FIG. 3 is an elevational oblique left rear view of the first embodiment of the gun mount of the invention showing the guns, mounts and mechanical and/or electrical adjustment mechanisms, in particular the adjustment motors. The star wheel and two cans are shown for clarity as well. Star wheel 110 has circumferential pockets 112, 114. These two pockets are empty but cans 116, 118 may be seen placed in two more pockets (unnumbered for clarity).

Note that the high level of detail provided by these drawings and the number of moving parts means that various parts are not visible or are greatly obscured and the numbering of the parts varies from drawing to drawing, even in FIGS. 3 through 9 in which the core of the system is shown and the remainder is eliminated for clarity. Thus it may be necessary to look to multiple drawings in order to see all portions of the invention clearly.

First spray gun 120 is referenced herein and in the numbering for clarity, however it will be apparent from the drawings that the second spray gun 122 has the same systems and components in use for this invention. Obviously, doubling the number of reference numerals would detract from the high level of clarity of these drawings. Second spray gun 122 is disposed to spray into a different can from the first spray gun, so as the star wheel 110 indexes around in rotation, two guns are spraying two parts of two different cans: each can is fully sprayed after pausing beneath both of the guns, and then is removed for processing by other machinery such as ovens and so forth All four motors, both sliders, guides, guns, gun mounts etc. all are mounted to 135, the X-axis actuator motor mount, which in turn is part of the overall spray gun mount assembly/Z-axis slide 124.

The spray gun mount assembly/Z-axis slide 124 rides on the Z beam 140 and thus carries with it most of the elements/components of the present invention, although it is not presently contemplated that the programmable logic controller (PLC or HMI) will be carried. By means of the Z beam 140 and assembly 124 riding thereon, the depth/proximity of the spray gun nozzles 130 to the cans 116, 118 can be controlled.

First spray gun mount 125 is somewhat difficult to see located under the gun and atop the X-axis slide 132. However, the gun mount 125 (or equivalent) is necessary for the operation of the invention: it rides in/on a rotation guide 133 and has a tail or projection which extends outward to provide leverage to an X-axis rotation bracket 134. It will be seen that when the bracket 134 pulls or pushes on the mount 125, the mount and spray gun 120 must physically move together to cause a rotation about nozzle 130, NOT a rotation about the gun mount itself. This is because the rotation guide 133 has an arcuate shape, the arc having a focus disposed at the location of the nozzle 130. Thus in rotation, the nozzle 130 only rotates without moving while the rest of the spray gun 120 moves in order to allow the nozzle 130 to remain in one place while rotating.

First spray gun X-axis actuator motor 126 may be seen to be driving a small worm drive screw which is mechanically engaged to the X-axis slide 132, so when the X-axis actuator 126 is energized, it will move the slide by a known and invariant amount precisely dependent upon the control of the X-axis actuator 126. If the actuator 126 is energized to turn 3 degrees internally, turning the screw 3 degrees, the X-axis slide 132 will move one amount in traverse, but if the motor 126 is turned sufficiently to turn 3 complete revolutions (1080 degrees) the X-axis slide 132 will obviously move 360 times as far in traverse. This motion is controllable, known, and repeatable and thus extremely useful for the precision control over spray gun position and rotation which is necessary for the adjustments discussed in the Background section of this application.

First spray gun X-axis rotation motor 128 offers this same precision, repeatable, performance, although acting in rotation via bracket 134 as discussed previously.

Figure 11:
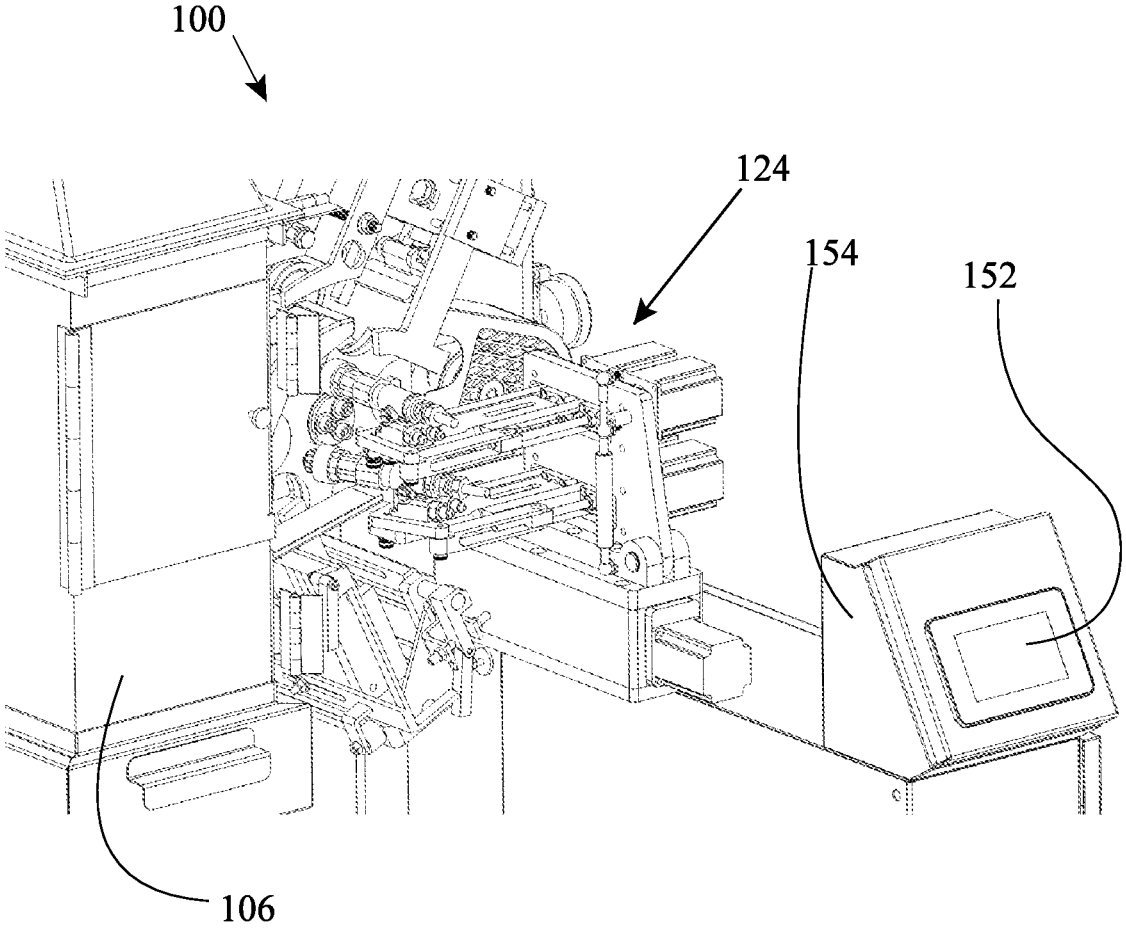
FIG. 11 is a drawing of an overall machine showing a control panel mounted on a programmable logic controller.

Thus it is instantly seen that the operator, or a PLC, or an operator running the PLC in order to run the IC machine 100, can control with the push of a button that which previously required painstaking manual adjustment and judgement from experience. (A controller/PLC 154 with a control panel 152 is shown in FIG. 11.)

Figure 12:
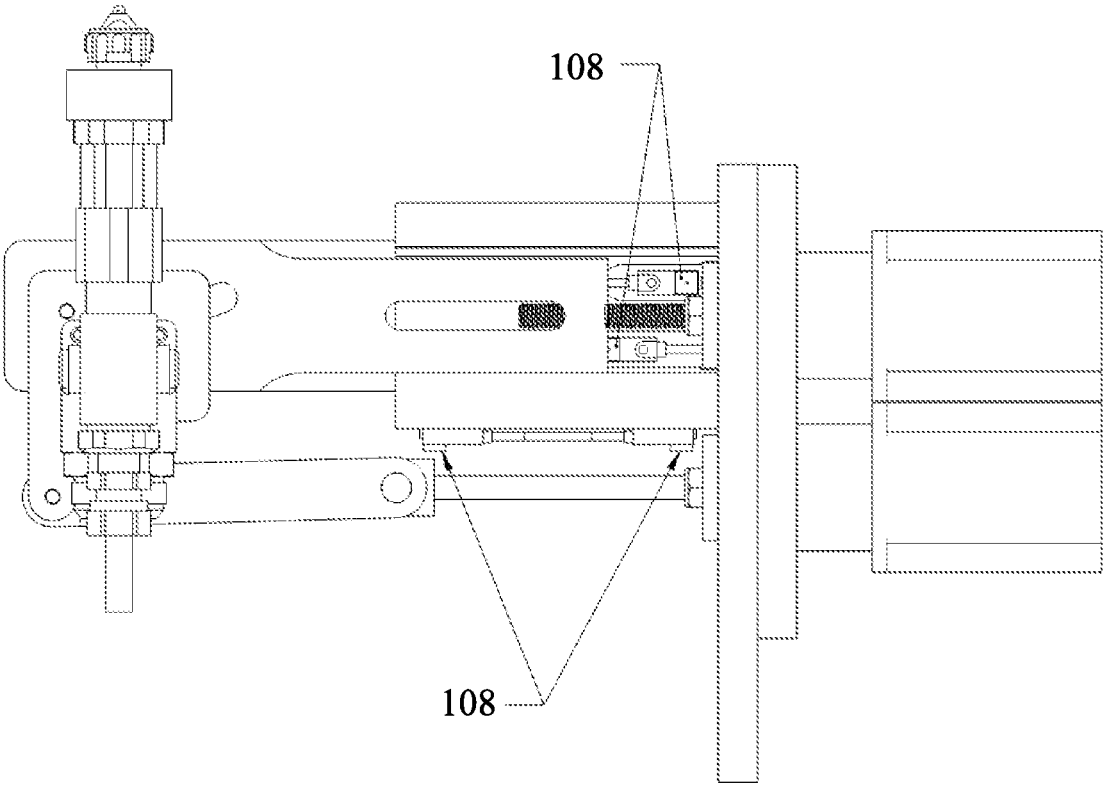
FIG. 12 is a elevated planform view showing limit switches used as sensor to detect motion in rotation and translation.

A sensor 108 (a limit switch) is depicted in FIG. 12.

Figure 4:
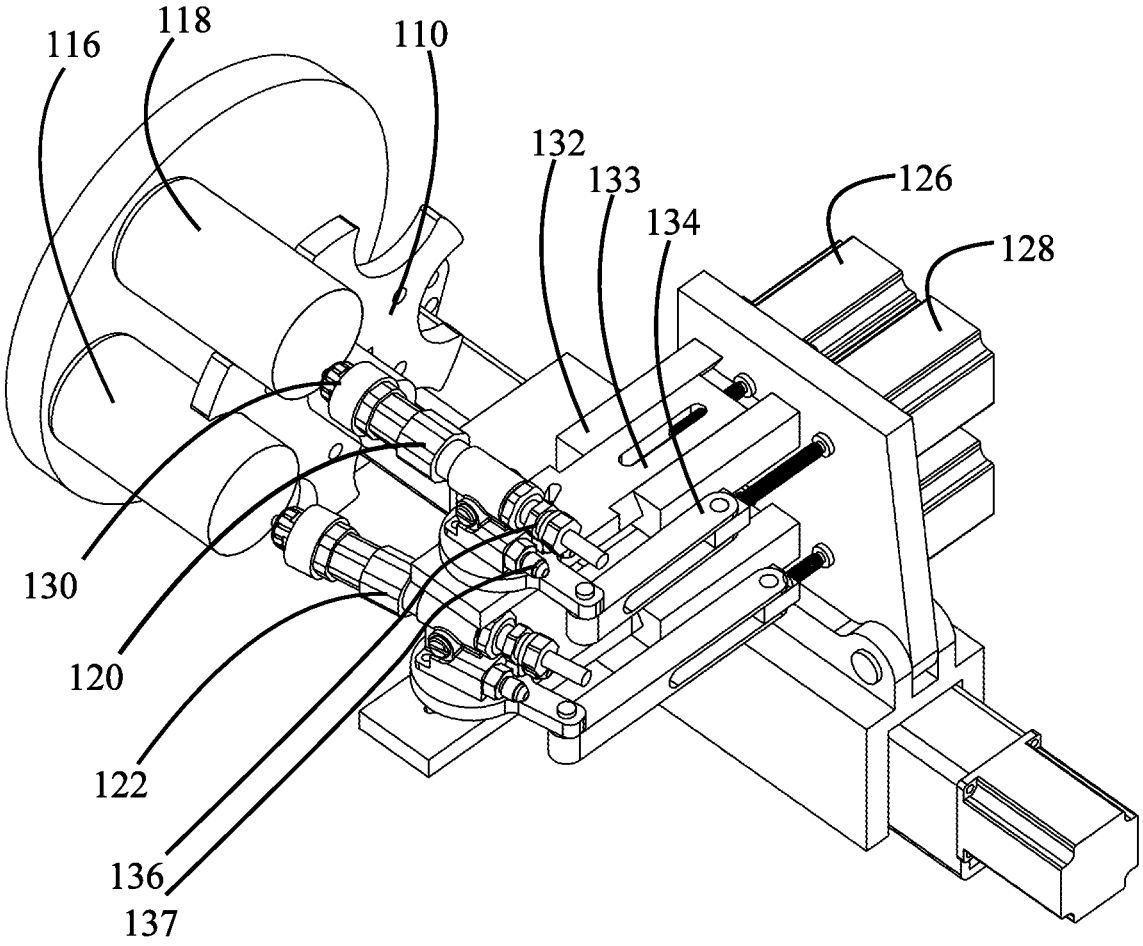
FIG. 4 is an elevational oblique right rear view of the gun mount of the invention showing the guns, the gun mounts and the mechanical and/or electrical adjustment mechanisms, in particular the adjustment motors.
Figure 5:
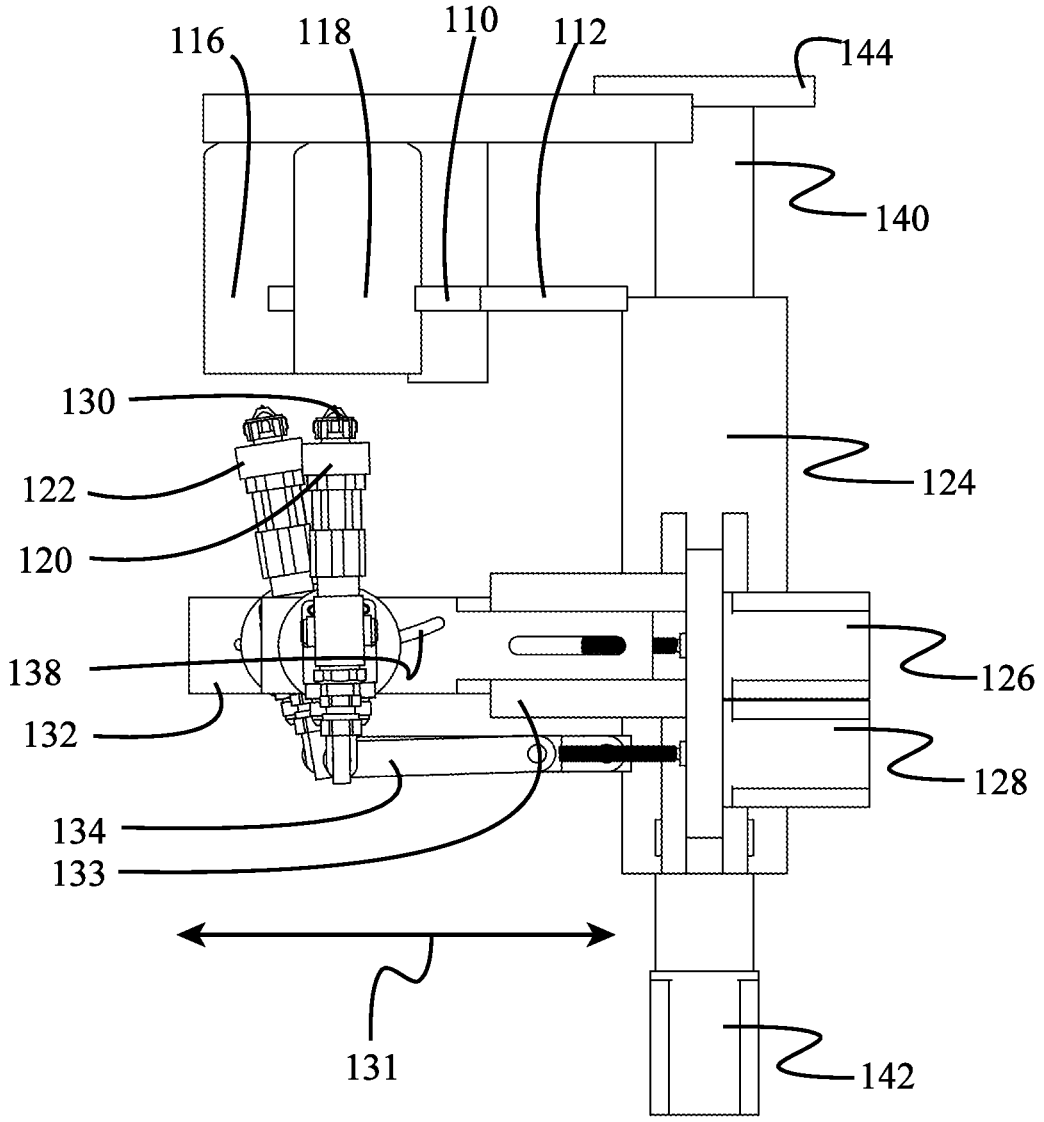
FIG. 5 is a direct top view of the first embodiment of the gun mount of the invention showing the guns, the gun mounts and the mechanical and/or electrical adjustment mechanisms, in particular the adjustment motors.
Figure 6:
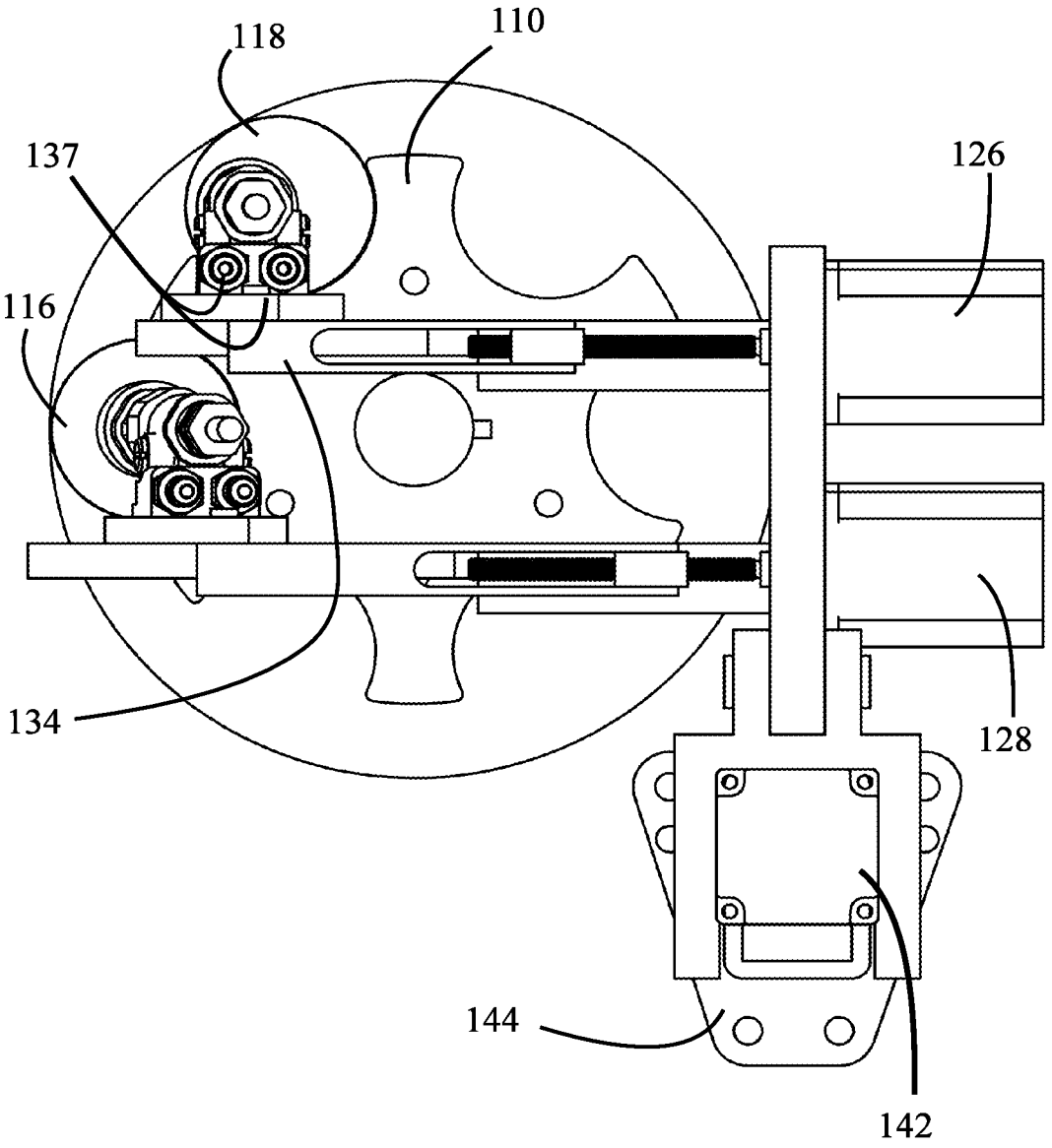
FIG. 6 is a direct rear view of the gun mount of the invention.

FIG. 4 is an elevational oblique right rear view of the gun mount of the invention showing the guns, the gun mounts and the mechanical adjustment mechanisms, in particular the adjustment motors. FIG. 5 is a direct top view of the first embodiment of the gun mount of the invention showing the guns, the gun mounts and the physical adjustment mechanisms, in particular the adjustment motors. The rotation guide 138 is seen here: in this presently preferred and best mode now contemplated for carrying out the invention, it is a simple slot, but any equivalent may be used within the scope of the claims. FIG. 6 is a direct rear view of the gun mount of the invention. FIGS. 4 and 6 in particular clearly show the doubled gun arrangement previously discussed, and that both guns have gun mounts controlled by an X-axis actuator and an X-axis rotation actuator, with all four actuator motors riding on 124, the Z-beam rider gun mount assembly.

Figure 7:
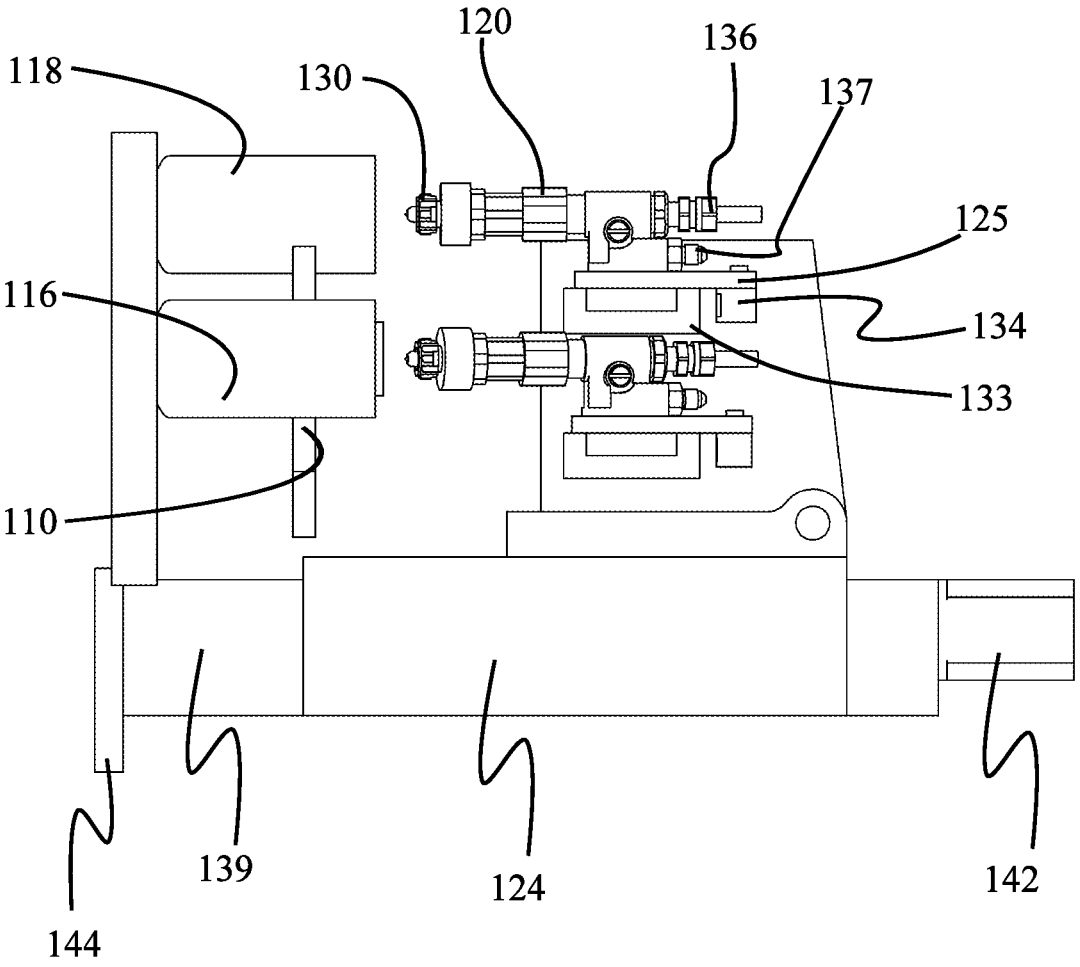
FIG. 7 is a right-side view of the gun mount of the first embodiment showing the guns and the gun mounts in relation to the cans being sprayed.
Figure 9:
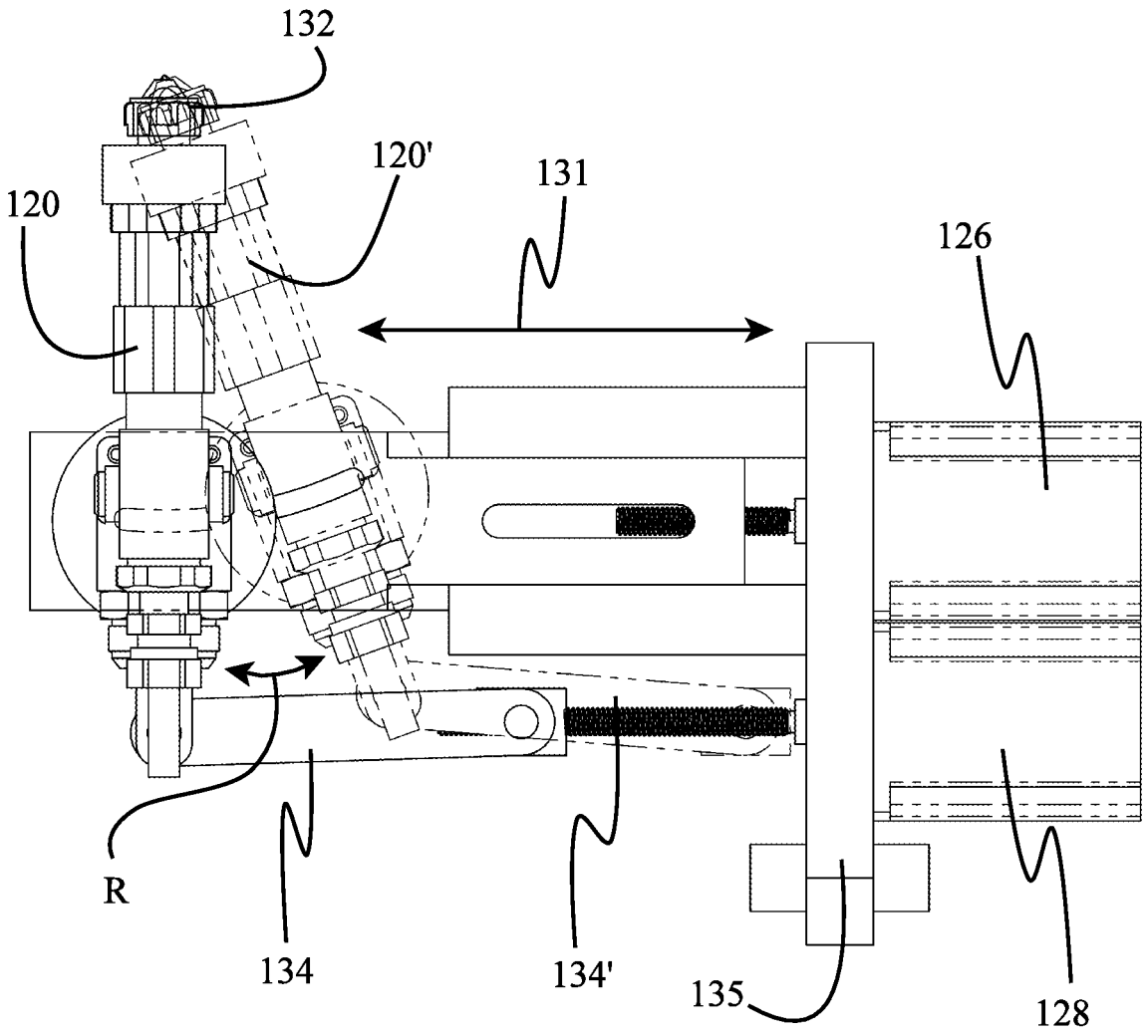
FIG. 9 is a top view of a single gun being adjusted into two different positions, showing in particular the fact that the gun rotates about the spray gun nozzle tip, and not about the rear end of the gun, with the action of the two actuator motors and the mounts which make this happen properly.

FIG. 5 should be carefully compared with FIG. 9 and the difference understood. It may be seen that FIG. 5 is showing two guns. On the other hand, FIG. 9 is showing a single gun in two different rotations or modes. The single gun is shown rotating to a new position for a different mode of operation. FIG. 7 is a right-side view of the gun mount of the first embodiment showing the guns and the gun mounts in relation to the cans being sprayed. This view not only shows the opposite side view of the Z-beam 139, the assembly 124 and the Z-axis actuator motor 142 but also provides a clear view to the spray gun inlets 137. In practice these will have feed lines running to them, but for clarity the four liquid supply/feed lines have been omitted.

At this point it is now clear that the following relationships apply. (It will be necessary to review various different drawings in order to see all components clearly.)

1) X-axis actuator motor 126 controls the location of the spray gun 120 on the X-axis slide 132 in the X-axis 131. It both prevents motion when not energized and forces motion when energized.
2) X-axis rotation actuator motor 128 controls the orientation of the spray gun nozzle 130 on the gun mount 125 riding on the guide 133. The motor 128 both prevents rotation when not energized and forces motion (via bracket 134) when energized.
3) Z-axis actuator motor 142 controls the depth/distance of the spray gun nozzle 130 on the entire spray gun mount assembly 124/motor mount 135 riding on Z-axis beam 139. It prevents motion when not energized and forces motion when energized.
4) Since the degree of motion of each actuator/motor can be controlled, individual modes or settings of location and angle may be predetermined and quickly used.

Figure 8:
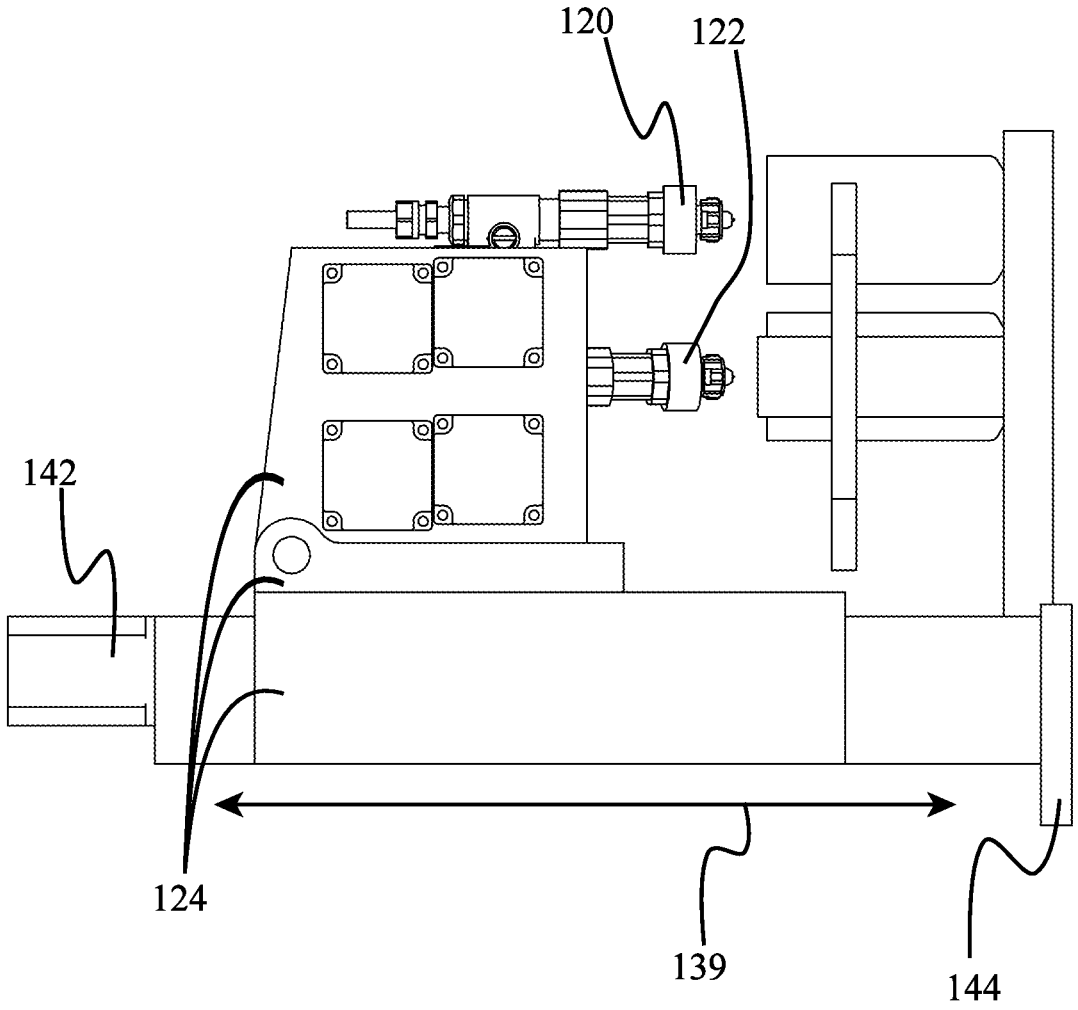
FIG. 8 is a left side view of the invention, showing the adjustment motors of the invention and the operation of the Z-axis mechanism.

FIG. 8 is a left side view of the invention, showing the adjustment motors of the invention and the operation of the Z-axis mechanism.

FIG. 8 neatly shows the Z-axis 139 of motion in traverse, which measures the depth of the spray guns, or their distance to the cans 116/118. Obviously, the depth of the guns is a crucial factor for numerous reasons like coverage, density of spray and so forth.

FIG. 8 also subtly shows a fact alluded to elsewhere: careful examination of (upper) gun 120 and (lower) gun 122 shows that they really are subtly angled relative to one another. This is in complete contrast to FIG. 9, which shows the motion of a single gun 120, and is important for understanding the nozzle-centric rotation of the gun 120.

Finally, FIG. 7 and FIG. 8 both clearly show the Z-axis mount to the overall IC machine 144, by which the device of the invention may be joined to the overall machine, or even retrofitted hypothetically, to older IC machines already in service.

FIG. 9 is a top view of a single gun being adjusted into two different positions, showing in particular the fact that the gun rotates about the spray gun nozzle tip, and not about the rear end of the gun, with the action of the two actuator motors and the mounts which make this happen properly. As noted previously, an actuator motor can be any of a wide range of devices, some of which are not technically electrical motors.

As a preliminary matter, the dimension R of rotation is depicted with an arrow. The plane of rotation is the X-Z plane. Notice that the rear end 136 of the gun 120 is what is moving, not the nozzle end.

Bracket 134 is seen in ghost outline 134' to be in a new position, thus putting (ghost) gun 120' in a new position.

If the gun nozzle moved when rotated, that is, if rotation occurred about the rear end 136 of the gun or the middle of the gun, all possible easy rotation would become extremely complex: the rotation would throw off the X-axis, so the X-axis would have to be adjusted, which would in a negative feedback loop then alter the angle of the gun nozzle requiring another rotation, and so forth and so on until higher math ensues. Operators do not have time during a production run for this complexity.

FIG. 9 also shows the X-axis itself, although this has nothing to do with gun rotation and everything to do with gun traverse/translation. The X-axis 131 is adjusted by motor/actuator/valve 126, the angle by motor/valve/actuator 128.

Figure 10:
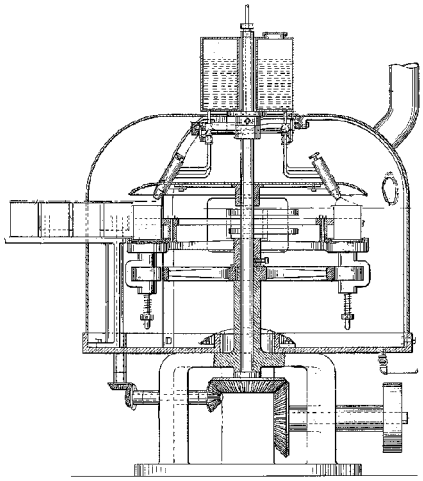
Fig. 10 PRIOR ART
FIG. 10 is a PRIOR ART diagram from U.S. Pat. No. 1,185,889 to Eberhart on Jun. 6, 1916, for AUTOMATIC CAN SPRAYING MACHINE.

FIG. 10 is a PRIOR ART diagram from U.S. Pat. No. 1,185,889 to Eberhart on Jun. 6, 1916, for AUTOMATIC CAN SPRAYING MACHINE. This figure, found only in the US PTO files, is the best available image. There is no accommodation made in this PRIOR ART for adjustment of spray guns. Later known systems do allow for adjustment, but they only allow manual adjustment and that manual process is of course based only on years of operator experience.

FIG. 11 is a drawing of an overall machine showing a control panel 152 mounted on a programmable logic controller 154. These may be mechanically or electronically connected to the actuator motors discussed in order to control the mechanical adjustments discussed.

FIG. 12 is an elevated planform view showing limit switches used as sensors to detect motion in rotation and translation. When motion of a component reaches and closes a limit switch 108, the controller 154 will receive a signal, the closure signal telling the controller/operator exactly where the actuator motor has moved the component. It may be seen that the limit switches are positioned on both the rotation control mechanisms and the X-axis translation mechanisms. Other sensors of the same type may be used on the Z-axis.

Other types of sensors may be employed. Optical sensors, contacts, mechanical, electrical and so forth are all usable within the invention.

Note that one advantage that servo motors have over stepper motors is that servos track their own motions and thus do not require additional sensors: in effect the servo motor becomes both the actuator motor and also the sensor.

Figure 13:
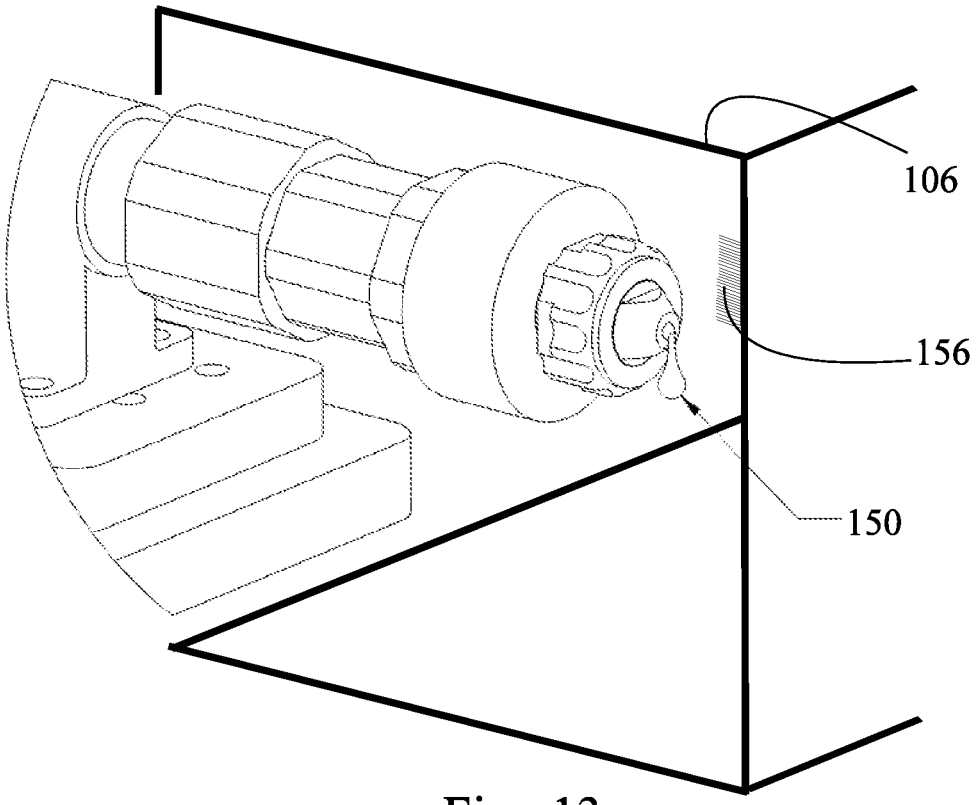
FIG. 13 is a partial view showing the nozzle end of a spray gun with a droplet of coating, a "pigtail" dangling therefrom.

FIG. 13 is a partial view showing the nozzle end of a spray gun with a droplet of coating, a pigtail 150 dangling therefrom. It will be seen that the pigtail may be removed by moving the nozzle to a third position, for example, one which scrapes the nozzle across a flexible cleaning blade 156, or orients the nozzle into the capture hood 106 and then sprays the nozzle, or does both, etc. This may be on a schedule, as with all other adjustments the device may make, or as needed, or ordered by an operator, and so forth. The blade 156 may be a brush type blade, or a solid flexible material similar to rubber, or a brush type, or other types so long as they act to dislodge the pigtail but do not damage or clog the nozzle.

A number of modes of operation and positioning can now be contemplated and used. For example, the actuator motors may have a first setting/mode in which they are properly positioned for a first size and shape of can, with a first type of gun, with fresh un-worn nozzles thereon. In a second setting, the nozzles may be repositioned to spray a second size and shape of can, still with the same type of gun, still with fresh nozzles having no erosion. However, in a third setting/mode, the guns placement and angle may be adjusted to account for replacement of the old guns with a new gun set having different characteristics such as size and length. In yet a fourth mode, an adjustment may be made to reflect wear/erosion of the nozzles. In yet a fifth mode, a combination of these adjustments/settings/modes may be applied, that is, a setting for old nozzles that are somewhat eroded being used with a new can size, or even a new nozzle having a material which wears out at a different rate and needs adjustment at a different rate.

There are additional modes of use available. In a sixth mode, the guns may be directed to fire at a fixed time interval (for example, 10 minutes, or for another example, whenever ambient temperature subceeds 20 degrees Celsius, or a different time period, or other conditions, etc.). In yet another mode of operation, the guns may be moved to point at the evacuation hood 106, to have "pig tails" or other buildups removed by means of a burst of higher pressure spray, longer spray bursts, multiple spray bursts, by rubbing the nozzle across a cleaning surface or blade, or simply by manual action by the operator, such action made easier due to the guns being rotated away from the dense machinery about the star wheel 110.

The disclosure is provided to render practicable the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

The word "such" in the appended claims indicates non-claimed matter, in particular, cans and containers. The invention is a machine for coating the interiors of such cans and containers for beverage or food.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

What is claimed is:

1. An internal coating spray machine for use with cans and containers, the internal coating spray machine comprising:

an exhaust hood;

a star wheel having a plurality of pockets;

a first spray gun having a nozzle, the first spray gun and first spray gun nozzle oriented so as to spray into a first one of the plurality of pockets and into one such can disposed in the pocket;

a first spray gun mount, the first spray gun mounted thereon, a first rotation guide, the first spray gun mounted riding on the first rotation guide, whereby the first spray gun mount and the first spray gun may both rotate in a single dimension designated R;

a first X-axis slide, the first X-axis slide having the first rotation guide;

a first X-axis guide, the first X-axis slide mechanically engaged to the first X-axis slide;

a first X-axis actuator motor mount, the first X-axis guide mounted to the first X-axis actuator motor mount, whereby the first X-axis slide, the first rotation guide, the first spray gun mount, and the first spray gun may all traverse in a single dimension designated X;

a first X-axis actuator motor mounted on the first X-axis actuator motor mount, the first X-axis actuator motor mechanically engaged to the first X-axis slide so that the traverse in the single dimension X is both caused and controlled by the first X-axis actuator motor;

a first X-axis rotation bracket mechanically engaged to the first spray gun mount;

a first X-axis rotation motor mounted on the X-axis actuator motor mount, the first X-axis actuator motor mechanically engaged to the first X-axis rotation bracket, whereby the rotation in the single dimension R is both caused and controlled by the first X-axis rotation actuator motor;

whereby when the first X-axis actuator motor and the first X-axis rotation actuator motor are energized in a first mode, the first spray gun will assume a first position and a first angle relative to the first one of the plurality of pockets, but when the first X-axis actuator motor and the first X-axis rotation actuator motor are energized in a second mode, the first spray gun will assume a second position and a second angle relative to the first one of the plurality of pockets.

2. The internal coating spray machine of claim 1 further comprising:

the first rotation guide having a partial circular shape having a focus, the focus located at the first spray gun nozzle, whereby rotation in the single dimension R occurs about the first spray gun nozzle.

3. The internal coating spray machine of claim 2, further comprising:

the first X-axis motor mount riding on a Z-axis beam whereby the first X-axis motor mount, first X-axis slide, the first rotation guide, the first spray gun mount, and the first spray gun, as well as the first X-axis rotation actuator motor and the first X-axis rotation bracket may all traverse in a single dimension designated Z orthogonal to the single dimension designated X;

a Z-axis actuator motor mechanically engaged to the first X-axis motor mount whereby the traverse in the single dimension Z is both caused and controlled by the Z-axis rotation actuator motor.

4. The internal coating spray machine of claim 3, wherein at least member of the group consisting of: the first X-axis actuator motor, the first X-axis rotation actuator motor, and the Z-axis actuator motor comprises: an actuator.

5. The internal coating spray machine of claim 3, wherein at least member of the group consisting of: the first X-axis actuator motor, the first X-axis rotation actuator motor, and the Z-axis actuator motor comprises: a servo motor.

6. The internal coating spray machine of claim 3, wherein at least member of the group consisting of: the first X-axis actuator motor, the first X-axis rotation actuator motor, and the Z-axis actuator motor comprises: a stepper motor.

7. The internal coating spray machine of claim 3, wherein at least member of the group consisting of: the first X-axis actuator motor, the first X-axis rotation actuator motor, and the Z-axis actuator motor comprises: a pneumatic actuator.

8. The internal coating spray machine of claim 3, further comprising: a control panel.

9. The internal coating spray machine of claim 3, wherein the star wheel is oriented in a vertical plane of rotation.

10. The internal coating spray machine of claim 9, wherein the rotation guide allows the rotation in the single dimension R to point the first spray gun nozzle in a third position and a third angle pointing away from the first pocket and toward the exhaust hood, whereby when the first X-axis actuator motor and the first X-axis rotation actuator motor and the Z-axis actuator motor are energized in a third mode, the first spray gun will assume the third position and the third angle, and thus further whereby the nozzle may be cleaned.

11. The internal coating spray machine of claim 9, further comprising: a controller operative to energize the actuator motors in the first, second and third modes as desired or according to a schedule.

12. The internal coating spray machine of claim 3, wherein the star wheel is oriented in a horizontal plane of rotation.

13. The internal coating spray machine of claim 12, further comprising:

a second spray gun having a nozzle, the second spray gun and second spray gun nozzle oriented so as to spray into a second one of the plurality of pockets and into a second such can disposed in the second pocket;

a second spray gun mount, the second spray gun mounted thereon, a second rotation guide, the second spray gun mounted riding on the second rotation guide, whereby the second spray gun mount and the second spray gun may both rotate in the single dimension designated R;

a second X-axis slide, the second X-axis slide having the second rotation guide;

a second X-axis guide, the second X-axis slide mechanically engaged to the second X-axis slide;

a second X-axis actuator motor mount, the second X-axis guide mounted to the second X-axis actuator motor mount, whereby the second X-axis slide, the second rotation guide, the second spray gun mount, and the second spray gun may all traverse in the single dimension designated X;

a second X-axis actuator motor mounted on the second X-axis actuator motor mount, the second X-axis actuator motor mechanically engaged to the second X-axis slide so that the traverse in the single dimension X is both caused and controlled by the second X-axis actuator motor;

a second X-axis rotation bracket mechanically engaged to the second spray gun mount;

a second X-axis rotation motor mounted on the second X-axis actuator motor mount, the second X-axis actuator motor mechanically engaged to the second X-axis rotation bracket, whereby the rotation in the single dimension R is both caused and controlled by the second X-axis rotation actuator motor;

whereby when the second X-axis actuator motor and the second X-axis rotation actuator motor are energized in the first mode, the second spray gun will assume a third position and a third angle relative to the second one of the plurality of pockets, but when the second X-axis actuator motor and the second X-axis rotation actuator motor are energized in the second mode, the second spray gun will assume a fourth position and a fourth angle relative to the second one of the plurality of pockets.

14. The internal coating spray machine of claim 12, further comprising:

a second spray gun having a nozzle, the second spray gun and second spray gun nozzle oriented so as to spray into the first one of the plurality of pockets and into such can disposed in the first pocket;

a second spray gun mount, the second spray gun mounted thereon, a second rotation guide, the second spray gun mounted riding on the second rotation guide, whereby the second spray gun mount and the second spray gun may both rotate in the single dimension designated R;

a second X-axis slide, the second X-axis slide having the second rotation guide;

a second X-axis guide, the second X-axis slide mechanically engaged to the second X-axis slide;

a second X-axis actuator motor mount, the second X-axis guide mounted to the second X-axis actuator motor mount, whereby the second X-axis slide, the second rotation guide, the second spray gun mount, and the second spray gun may all traverse in the single dimension designated X;

a second X-axis actuator motor mounted on the second X-axis actuator motor mount, the second X-axis actuator motor mechanically engaged to the second X-axis slide so that the traverse in the single dimension X is both caused and controlled by the second X-axis actuator motor;

a second X-axis rotation bracket mechanically engaged to the second spray gun mount;

a second X-axis rotation motor mounted on the second X-axis actuator motor mount, the second X-axis actuator motor mechanically engaged to the second X-axis rotation bracket, whereby the rotation in the single dimension R is both caused and controlled by the second X-axis rotation actuator motor;

whereby when the second X-axis actuator motor and the second X-axis rotation actuator motor are energized in the first mode, the second spray gun will assume a third position and a third angle relative to the first one of the plurality of pockets, but when the second X-axis actuator motor and the second X-axis rotation actuator motor are energized in the second mode, the second spray gun will assume a fourth position and a fourth angle relative to the first one of the plurality of pockets.

* * * * *